US005112023A

United States Patent [19]

Sowers

[11] Patent Number: 5,112,023

[45] Date of Patent: May 12, 1992

[54] POLE SUPPORT APPARATUS HAVING TANK BASE

[76] Inventor: Ricky R. Sowers, 7306 East 6th Ave., Scottsdale, Ariz. 85251

[21] Appl. No.: 364,104

[22] Filed: Jun. 12, 1989

[51] Int. Cl.[5] ..... F16M 13/00

[52] U.S. Cl. ..... 248/519; 248/910; 273/1.5 R

[58] Field of Search ..... 248/519, 910, 524, 230; 273/1.5 R, 1.5 A

[56] References Cited

U.S. PATENT DOCUMENTS

| | | | |
|---|---|---|---|
| 1,739,009 | 12/1929 | Lorber | 248/230 X |
| 2,613,899 | 10/1952 | Wagner et al. | 248/910 X |
| 2,818,254 | 12/1957 | Dunn | 273/1.5 R |
| 3,119,588 | 1/1964 | Keats | 248/910 X |
| 3,650,530 | 3/1972 | Gantz | 273/1.5 R |
| 3,716,234 | 2/1973 | Lancellotti | 273/1.5 R |
| 3,841,631 | 10/1974 | Dolan | 248/910 X |
| 3,955,787 | 5/1976 | Brown | 248/524 X |
| 3,966,153 | 6/1976 | Fleck | 248/524 X |
| 4,145,044 | 3/1979 | Wilson et al. | 248/910 X |
| 4,591,126 | 5/1986 | Berney | 248/910 X |
| 4,759,545 | 7/1988 | Grable | 273/1.5 R |
| 4,793,611 | 12/1988 | Thornell | 248/910 X |

*Primary Examiner*—David L. Talbott
*Attorney, Agent, or Firm*—H. Gordon Shields

[57] ABSTRACT

Support apparatus for a pole includes a hollow base for receiving water, the weight of which supports a vertically extending pole, and the pole may be used for water sports, such as water basketball or water volleyball adjacent to a swimming pool. The pole extends into the base and is notched on the bottom to fit onto a notch conforming ridge on the bottom of the base. The apparatus includes an air vent and may include collars for helping to hold the pole.

17 Claims, 2 Drawing Sheets

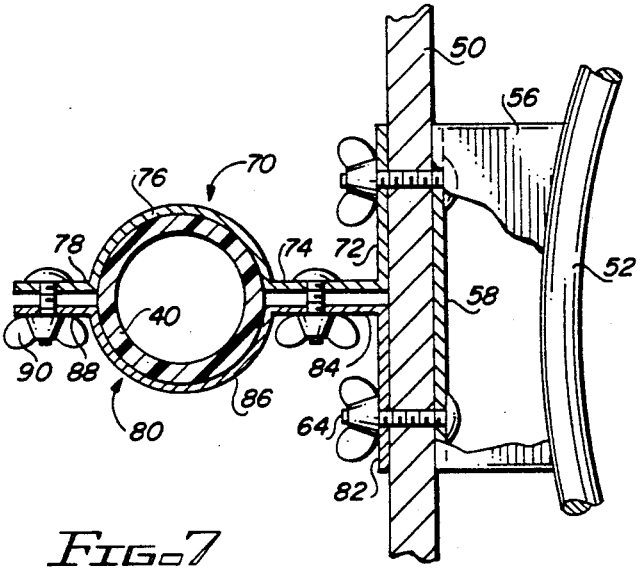
FIG. 7
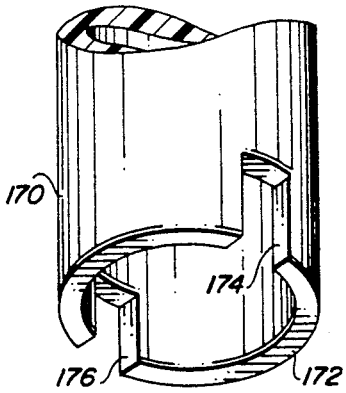
FIG. 10
FIG. 11
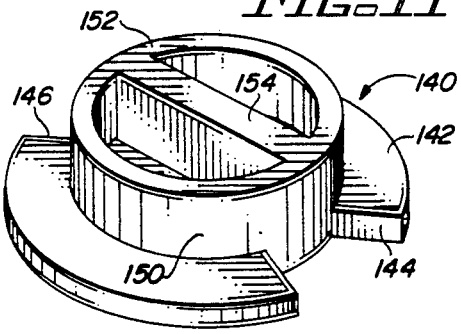
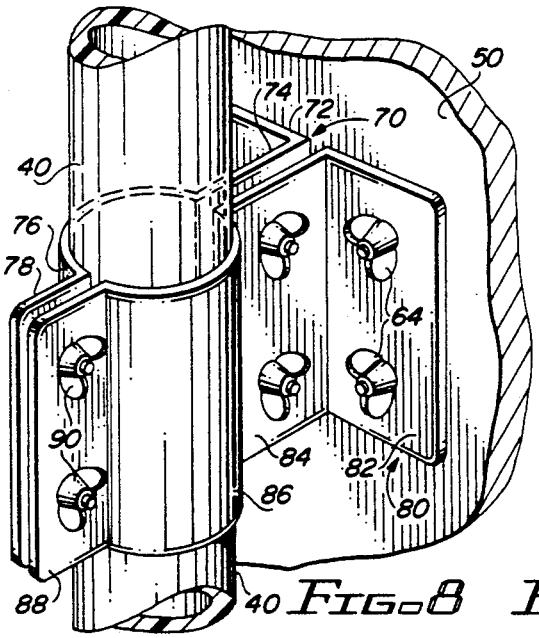
FIG. 8
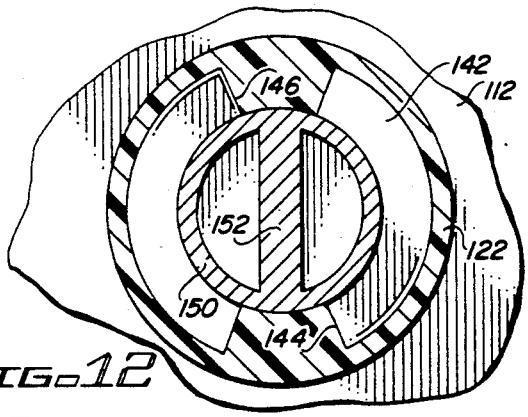
FIG. 12
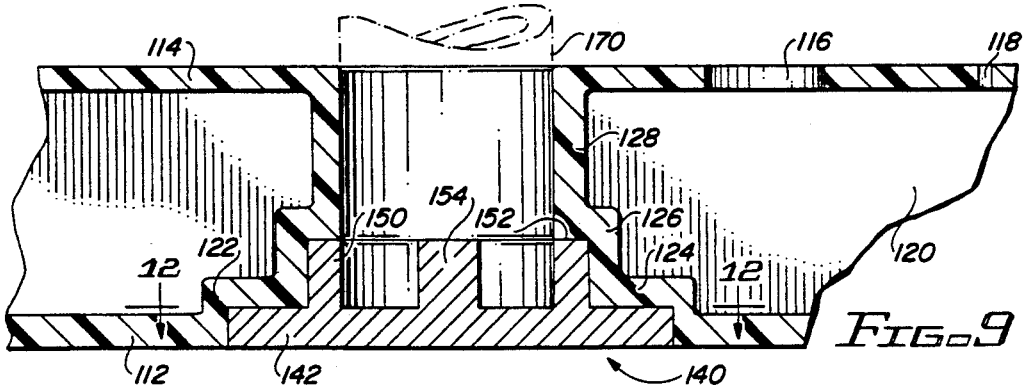
FIG. 9

POLE SUPPORT APPARATUS HAVING TANK BASE

BACKGROUND OF THE INVENTION

1. Field of the Invention

This invention relates to pole supports and, more particularly, to apparatus for holding a pole, including a base filled with water to provide weight support for the pole.

2. Description of the Prior Art

U.S. Pat. No. 1,240,376 (Saucier) discloses a support for a Christmas tree. The support is hollow and can be filled with water or sand. The base is of a generally conical configuration. A central tube, on the axis of the cone, receives the tree trunk.

U.S. Pat. No. 2,818,254 (Dunn) discloses a support base for supporting a swimming pool basketball set. The apparatus includes a base assembly made of rods, and a receptacle is filled with sand or the like and is disposed on top of some of the base rods.

U.S. Pat. No. 3,469,844 (Sindelar) discloses a water basketball apparatus in which the basket is secured to a floating ring or tube. A triangular support system extends from the ring or tube so that the basket is disposed over the center hole in the ring or tube.

U.S. Pat. No. 3,716,234 (Lancellotti) discloses collapsible basketball goal, pole, and base apparatus. The base doubles as a carrying case for the apparatus. The base may be filled with water, sand, or rocks, etc.

U.S. Pat. No. 3,743,286 (Weinhagen et al) discloses another water basketball system which includes sand bags or the like as ballast. Support structure for the backboard includes tubing, and the tubing includes horizontal portions which fit on the swimming pool deck. Sand bags or the like are then disposed on the horizontal tubing.

U.S. Pat. No. 3,841,631 (Dolan) discloses a portable basketball structure in which a water filled tank is disposed on a base. The base includes a single roller for moving the apparatus and adjustable foot supports for leveling the apparatus and for securing it in place. The tank includes a fill spout and a drain outlet.

U.S. Pat. No. 4,145,044 (Wilson et al) discloses a portable basketball system for children. The apparatus utilizes a base filled with sand or the like for stabilization. The base is relatively low, and the base is generally dome shaped for convenience. Since the apparatus is designed to be used by children, the basket and its backboard are appropriately relatively low. The "basketball" is made of sponge rubber or the like.

U.S. Pat. No. 4,201,975 (Marcus) discloses a display device which utilizes a water filled ballast tank on top of a base. The ballast fits on top of the base and has a center aperture through which a center receptacle of the base extends. A pole fits into the center receptacle.

U.S. Pat. No. 4,307,887 (Weiss) discloses a system for supporting poles for various games, such as basketball, volleyball, etc., for swimming pools. The apparatus is designed for above-ground swimming pools. The poles are supported on the outside of the swimming pool.

SUMMARY OF THE INVENTION

The invention described and claimed herein comprises a water filled base for supporting a pole. The base includes a ridge element extending upwardly from the bottom of the base, and the pole includes a notch to fit over the upwardly extending ridge element so that the bottom of the pole does not contact the bottom of the support base element. The mating ridge and notch also helps to prevent rotation of the pole during use.

Among the objects of the present invention are the following:

To provide new and useful support apparatus for supporting a pole;

To provide new and useful tank apparatus fillable with water;

To provide new and useful tank apparatus for supporting a pole and for receiving water for ballast;

To provide new and useful base apparatus for supporting a pole in which the bottom of the pole is disposed on a ridge element in the base; and To provide new and useful water filled base apparatus for supporting a pole adjacent to a swimming pool.

BRIEF DESCRIPTION OF THE DRAWING

FIG. 7 is a view in partial section illustrating a portion of the apparatus of the present invention.

FIG. 8 is a perspective view illustrating the portions of the invention shown in FIG. 7.

FIG. 9 is a view in partial section of an alternate embodiment of the apparatus of the present invention.

FIG. 10 is a perspective view of a portion of the apparatus of the present invention usable with the apparatus of FIG. 9.

FIG. 11 is a perspective view of a portion of the alternate embodiment of the apparatus of the present invention of FIG. 9.

FIG. 12 is a view in partial section taken generally along line 12—12 of FIG. 9.

DESCRIPTION OF THE PREFERRED EMBODIMENT

Figure 1:
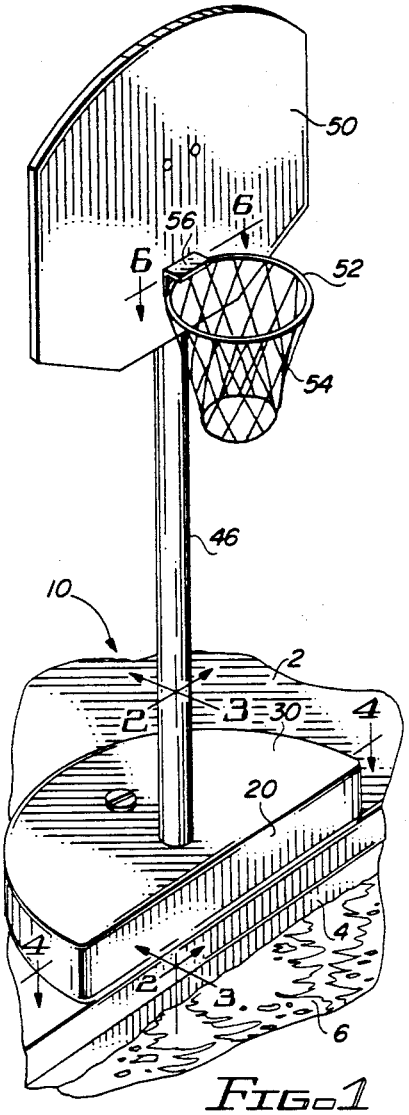
FIG. 1 is a perspective view of the apparatus of the present invention in a use environment.

FIG. 1 is a perspective view of a portion of the apparatus of the present invention and the use environment for the apparatus of the present invention. The use environment includes a swimming pool deck 2 disposed about a swimming pool 4. Water 6 is disposed in the swimming pool 4.

Pole support apparatus 10 of the present invention is disposed on the deck 2 adjacent to the swimming pool 4. The apparatus 10 is shown in FIG. 1 as including a pole 40 and supporting a basketball backboard 50. A hoop 52 is secured to the backboard 50 and a net 54 is secured to the hoop 52. The apparatus 10, including the pole 40, may be used in conjunction with a water basketball game used by swimmers (not shown) in the swimming pool 4.

Figure 4:
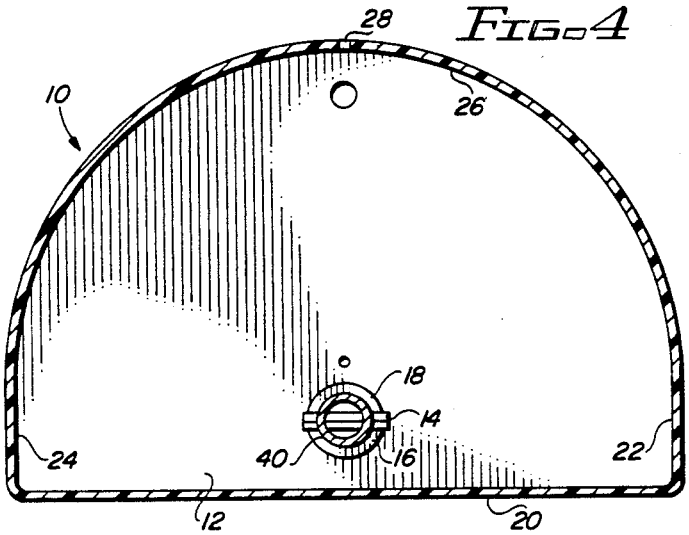
FIG. 4 is a view in partial section taken generally along line 4—4 of FIG. 1.
Figure 3:
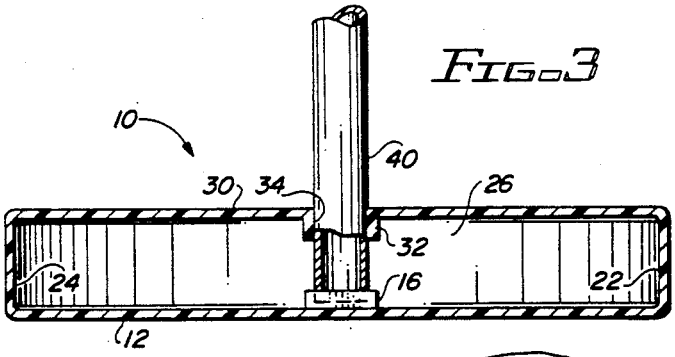
FIG. 3 is a view in partial section taken generally along line 3—3 of FIG. 1.
Figure 2:
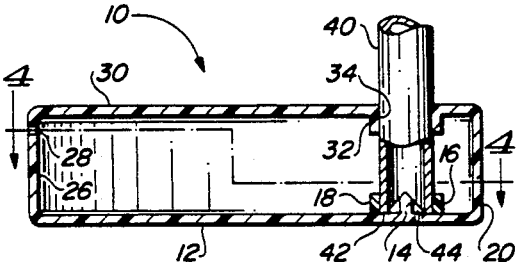
FIG. 2 is a view in partial section taken generally along line 2—2 of FIG. 1.

FIG. 2 is a view in partial section of the apparatus 10 taken generally from line 2—2 of FIG. 1. FIG. 3 is a view in partial section of the apparatus 10 taken generally along line 3—3 of FIG. 1. FIGS. 2 and 3 are views in partial section taken generally at ninety degrees to each other through the apparatus 10. They are both horizontal or side views, while FIG. 4 is a vertical or plan view. FIG. 4 is a view in partial section of the apparatus 10 taken generally along line 4—4 of FIGS. 1 and 2. For the following discussion, reference will primarily be made to FIGS. 1, 2, 3, and 4.

The apparatus 10 of the present invention comprises a support apparatus for supporting a pole, such as the pole 40. The pole 40 is in turn used to support another element. In FIG. 1, the "other element" includes the backboard 50, and the hoop 52 and net 54. In FIG. 4, the "other element" includes a net 70.

The apparatus 10 comprises a base which is a hollow container preferably filled with water to provide stability. The apparatus 10 includes a bottom 12, which is generally flat or planar, and which is disposed on the generally flat deck 2. A ridge 14, which is generally triangularly configured, is secured to the bottom 12. The ridge 14 cooperates with the pole 30, as will be discussed in detail below. A pair of generally circular elements 16 and 18 are also secured to the bottom 12 and are disposed adjacent to the ridge 14. The elements 16 and 18 comprise, respectively, front portions and rear portions of a support element or cup element which define a socket for receiving the pole 40. The ridge is also a part of the socket.

Extending upwardly from the bottom 12 is a front wall 20. A pair of side walls 22 and 24 also extend upwardly from the floor or bottom 12 and they extend rearwardly from the front wall 20. The side walls 22 and 24, as best shown in FIGS. 1 and 4, extend rearwardly from the front wall 20 for a relatively short distance before they begin to curve. The walls 22 and 24 blend into a curved rear wall 26. The rear wall 26 comprises a continuation of the side walls 22 and 24. The rear wall 26 is also secured to the bottom 12.

A vent hole or aperture 28 extends through the rear wall 26. The vent hole or aperture 28, as best shown in FIG. 2, is spaced downwardly a relatively short distance from a top wall 30. The top wall 30 is generally parallel to the bottom 12 and is appropriately secured to the front wall 20, the side walls 22 and 24, and the rear wall 26. The bottom 12, the walls 20, 22, 24, and 26, and the top wall 30 comprise or define a generally watertight container into which water may be added for ballast for supporting the pole 40 and its additional elements. The vent hole 28 allows excess water to escape and provides for the venting of the interior of the apparatus 10.

Extending downwardly from the top wall 30 is a reinforcing ring 32. The reinforcing ring 32 is disposed about an opening 34. The opening 34 is a hole or aperture through which the pipe 40 extends. The diameter of the opening 34 is substantially the same as the outer diameter of the pole 40.

The reinforcing ring 32 is appropriately aligned with the circular segments or elements 16 and 18.

Figure 5:
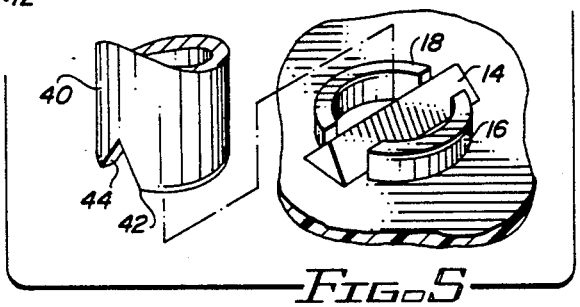
FIG. 5 is an enlarged perspective view of a portion of the apparatus of the present invention.

FIG. 5 is a perspective view of a portion of the bottom 12. The ridge 14 is shown extending upwardly from the bottom 12, and the segments 16 and 18 are shown adjacent to the ridge 14. The lower portion of the pole 40 is shown spaced apart from the bottom 12, the segments 16 and 18, and the ridge 14.

The pole 40 includes a generally flat or planar bottom 42, an a pair of generally triangularly shaped notches or slots 44, of which one notch is shown in FIG. 5. The notches 44 receive the triangular ridge 14. The ridge provides stability for the pole 40. As best shown in FIG. 4, the ridge 14 is generally parallel to the front wall 20 so that the ridge 14, with the segments 16 and 18, provides stability in the front and rear direction. The segments 16 and 18, together with a ring 32, also provides stability, both front and rear stability and also lateral stability. It will be noted, as in playing water basketball, that front and rear stability is of paramount importance.

Figure 6:
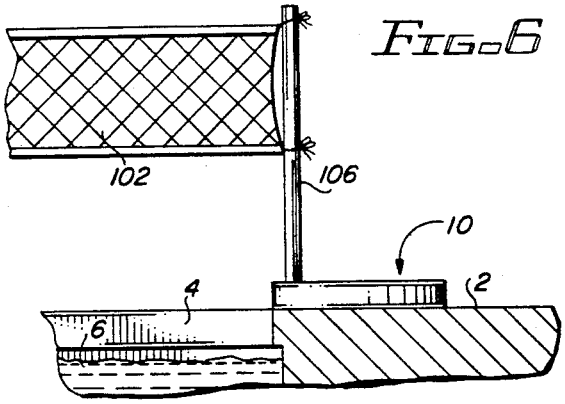
FIG. 6 is a side view illustrating an alternate use of the apparatus of the present invention.

FIG. 6 is a view in partial section of the deck 2, the pool 4, and the water 6, with the apparatus 10 disposed on the deck 6 at the pool 4. A pole 100, which is substantially identical to the pole 40, except, perhaps for its overall length, is appropriately extending into the apparatus 10. A net 102 is shown secured to the pole 60. The net 70 may be used for water volleyball, or the like.

The apparatus 10 may be used to support poles for various types of games. Moreover, it will be obvious that the apparatus 10 could be disposed other than adjacent to a swimming pool. For example, the apparatus 10 may be used to support a pole in other locations, and for other sports or activities such as volleyball, badminton, etc. Such locations may be remote from a swimming pool, and on a lawn, on a field, etc.

It will be understood that, if the apparatus 10 is made of a plastic composition, it will be relatively light when emptied. Accordingly, the apparatus 10, or a pair of such apparatus, may be conveniently carried to its/their use location. At the use location, the apparatus 10 may be easily filled with water by putting a water hose into the apparatus 10 through the opening 34. Excess water, if any, will flow through the vent hole or aperture 28. Then, after filling, the pole 40 (or a pole 100) is simply inserted through the hole 34, through the reinforcing ring 32, and onto the ridge 14 and within the socket defined by the segments 16 and 18.

The pole includes a pair of notches 44 which mate with the ridge 14 for added stability. Moreover, the ridge 14 and the notches 44 provide for rotational stability to prevent the pole 40 from inadvertently turning or twisting within the apparatus 10. Thus, the backboard 50, and its hoop 52, is maintained in the proper orientation regardless of ball impact or blows against the backboard 50 which could cause rotation of the backboard and the pole if the notches 44 and the ridge 14 were not present.

The base apparatus 10 may be conveniently drained at its use site without causing any detrimental effect since it is simply filled with water.

FIG. 7 is a view in partial section through the pole 40 where the pole 40 is secured to the backboard 50 and to the hoop 52. The pole 40, the backboard 50, and the hoop 52 are secured together by a pair of pole brackets 70 and 80.

FIG. 8 is a perspective view of a portion of the backboard 50 and the pole 40, and illustrating the pole brackets 70 and 80 used to secure the pole 40, the backboard 50, and the hoop 52 together. For the following discussion, reference will primarily be made to FIGS. 7 and 8.

Secured to the hoop 52 is a bracket base 56. The bracket base is in turn secured to a vertical flange 58. Obviously, the base 56 and the vertical flange 58 comprise a single piece of material with a right angle bend between the base 56 and the flange 58.

The flange 58 is disposed against the front surface of the backboard 50. Aligned with the flange 58 are vertical flange portions 72 and 82, respectively, of the pole brackets 70 and 80.

The pole brackets 70 an 80 are substantially identical. However, they are mere images of each other.

The bracket 70 includes the flange 72, disposed against the back surface of the backboard 50 and aligned with the flange 58. Extending outwardly from, and substantially perpendicular to, the flange 72, is an arm 74. A circular pole piece 76 is connected to the outer portion of the arm 74, remote from the flange 72. An arm 78 is also secured to the circular pole piece 76. The arm 78 is aligned with the arm 74.

The pole bracket 80, as indicated above, is substantially a mirror image of the pole bracket 70. In addition to the flange 82, which is aligned with the flange 72 of the pole bracket 70, the pole bracket 80 includes an arm 84 secured to the flange 82. A circular pole piece 86 is in turn secured to the arm 84 and is connected to another arm 88. The arms 84 and 88 are aligned with each other and are appropriately secured to opposite sides of the circular pole piece 86. The pole 84 is disposed within the pole pieces 76 and 86. The radii of the pole pieces 76 and 86 is substantially the same as the radius of the pole 40 so that the pole pieces mate with the curvature of the pole 40 to secure the backboard 50 to the pole 40.

The flanges 72 and 82 are appropriately secured to the flange 58, and to the backboard 50, by a plurality of appropriate fastening elements, such as bolts and wing nuts 64. The pole brackets 70 and 80 are appropriately secured together and to the pole 40 by another plurality of appropriate fasteners, such as the bolts and wing nuts 90.

By loosening the wing nut and bolt assemblies 90, the backboard 50 may be disposed at any desirable location on the pole 40. The backboard 50 may also be removed easily from the pole 50 by loosening the wing nut and bolt assemblies 90 and by then simply moving the pole 40 through the brackets 70 and 80. In the alternative, by removing one of the brackets 70 or 80 from both the backboard 50 and the pole 40, and also, of course, from the flange 58, the backboard may be removed from the pole 40 without vertical or longitudinal movement of the backboard 50 along the pole 40. That is, the backboard 50 may be separated from the pole 40 for storage purposes by either convenient way.

It will be understood that the overall size of the apparatus 10 may vary, depending on the volume of water, and thus the weight, desired. For children's games and/or toys, a smaller base apparatus may be required than for adult type games. Moreover, it is obvious that the configuration of the apparatus may vary from that illustrated herein.

As an alternative to the base 10, a base 110 is shown in FIG. 9. The primary difference between the base 110 and the base apparatus 10 is in the holding element for a pole 170, and in the configuration of a pair of notches at the base of the pole.

FIG. 9 is a side elevational view in partial section of the base 110. The base 110 includes a bottom plate 112, a top plate 114, and walls 120 extending between the bottom plate 112 and the top plate 114. A fill and drain aperture 116 extends through the top plate 114. A relatively small vent aperture 118 also extends through the top plate 114. The aperture 118 is spaced apart from the aperture 116.

The specific holding element for the pole 170 comprises an insert element 140. The insert 140 is disposed within the bottom plate 112. The insert 140 receives the bottom portion of a pole 170. The insert 140 is a metal insert, and a portion of the bottom 112 is molded about the insert 140.

FIG. 10 is a perspective view of the lower portion of the pole or pipe 170. The pole 170 includes a bottom rim 172. Extending upwardly from the bottom rim or bottom face 172 of the pole 170 is a pair of notches 174 and 176. The notches 174 and 176 are generally of a rectangular configuration. They extend axially along the pole 170, and are appropriately diametrically aligned with each other.

FIG. 11 is a perspective view of the insert 140. The insert 140 is shown in FIG. 12 as molded into the bottom 112 of the base 110. FIG. 12 is a top view in partial section of the insert element 140 and the associated portion of the bottom 112, taken generally along line 12—12 of FIG. 9. For the following discusssion, reference will primarily be made to FIGS. 9, 10, 11, and 12.

The insert 140 includes a base plate 142. Extending upwardly from the base plate 142 is a cylinder or cup 150. The cylinder or cup 150 includes a top surface 152. A pair of notches 144 and 146 extend inwardly in the base plate 142 to the cylinder or cup 150. As shown in FIG. 12, a portion of the bottom 112 is molded about the base plate 142 and in the notches 144 and 146.

Extending diametrically across the cup 150 is a ridge 154. The ridge 154 is generally of a rectangular configuration. The notches 174 and 176 of the pole 170 extend over the opposite ends of the ridge 154. That is, the ridge 154 extends into the pole 170 and into the notches 174 and 176. The inside diameter of the cup 150 is substantially the same as, or slightly greater than, the outside diameter of the pole 170. The pole 170 fits within the cup or cylinder 150, and the ridge 154 extends into the notches 174 and 176 to prevent the pole 170 from rotating. The height of the ridge 154, upwards from the base 142, is slightly greater than the overall length of the notches 174 and 176 upwards from the bottom 172.

The molded portion of the bottom plate 112 of the base apparatus about the insert element 140 includes a vertically extending wall 122, and a horizontally extending wall 124. The vertically and horizontally extending walls 122, 124 are disposed up the sides and inwardly over the base 142 of the insert 140.

A vertically extending wall 126 extends upwardly from the horizontally extending wall 124 and about the cylindrical wall of the cup 150. A second vertical wall 128 extends upwardly from the top 152 of the cylindrical cup 150. The vertical walls 126 and 128 are joined together. The vertical walls 122, 126, and 128 are, of course, cylindrical in configuration. The top of the cylindrical wall 128 is secured to the top 114 of the base 110. The vertical wall 128 extends from the top 152 of the cylinder 150 to the top plate 114. The cylindrical vertical wall 128 has an interior diameter which is substantially the same as, or very slightly greater than, the exterior diameter of the pipe 170.

The vertical wall 128 comprises an integral holding element which cooperates with both the insert 140 and the base or bottom plate 112 to secure the pipe 170 to the base apparatus 110.

The insert 140 is preferably made of metal, and the base apparatus 110 is preferably made of an appropriate plastic material. The pole 170 may be made of metal or plastic, as desired.

The pole or pipe 170 is generally substantially the same as the pole or pipe 40. The primary difference between the pole 40 and the pole 170 is in the configuration of the notches at the bottom or lower end of the pipes or poles 40 and 170. The configuration of the slot or notch 44, and its aligned mate, as best shown in FIGS. 2 and 5, is generally triangular. The configuration of the notches 174 and 176 of the pipe or pole 170 is generally rectangular.

While the principles of the invention have been made clear in illustrative embodiments, there will be immediately obvious to those skilled in the art many modifications of structure, arrangement, proportions, the elements, materials, and components used in the practice of the invention, and otherwise, which are particularly adapted to specific environments and operative requirements without departing from those principles. The appended claims are intended to cover and embrace any and all such modifications, within the limits only of the true spirit and scope of the invention.

What I claim is:

1. Apparatus for supporting a pole having a notched bottom, comprising, in combination:

cup means for receiving the notched bottom of the pole, including a base plate, a cup extending upwardly from the base plate for receiving the pole, and a ridge extending diametrically across the cup for extending into the notched bottom of the pole;

bottom wall means, including a bottom wall, a vertically extending wall about the base plate, an inwardly extending wall over the base plate, and an upwardly extending wall about the cup;

side wall means secured to the bottom wall and extending upwardly from the bottom wall and defining upwardly extending sides of the apparatus; and top means secured to the side wall means for closing the apparatus and for defining, with the bottom wall means and the side wall means, an enclosed and generally hollow base for receiving a quantity of water for ballast to support the pole.

2. The apparatus of claim 1 in which the wall means includes vent means for venting the base.

3. The apparatus of claim 1 in which the top means includes fill means for filling and draining the base.

4. The apparatus of claim 1 in which the top means includes an aperture aligned with the cup means through which the pole extends.

5. The apparatus of claim 4 in which the top means includes a reinforcing ring about the aperture and extending downwardly therefrom.

6. The apparatus of claim 1 in which the top means includes a top wall, an aperture in the top wall aligned with the cup means, and a reinforcing ring secured to the top wall about the aperture and extending downwardly towards the cup means.

7. The apparatus of claim 1 in which the top means further includes a fill aperture for filling and draining the apparatus and a vent aperture for venting the apparatus.

8. The apparatus of claim 1 in which the pole means includes clamp means for securing the gaming element to the pole.

9. The apparatus of claim 8 in which the clamp means includes a first curved portion, a second curved portion, the first and second curved portions adapted to receive the pole, means for securing the first and second curved portions to the pole, and plate means secured to the first and second curved portions for securing to the gaming element to secure the gaming element to the pole.

10. The apparatus of claim 1 in which the wall means includes a generally flat front portion and a generally curved portion, and the cup means is disposed adjacent to the flat front portion.

11. The apparatus of claim 1 in which the ridge is a generally rectangularly shaped element.

12. The apparatus of claim 11 in which the cup means further includes a notch on the base plate, and the bottom means further includes a bottom wall portion that extends into the notch.

13. The apparatus of claim 1 in which the cup is a generally circular cup.

14. The apparatus of claim 1 in which the top means includes:

a top plate, an aperture in the top plate aligned with the cup means through which the pole extends; and reinforcing means extending about the aperture between the top plate and the cup means.

15. The apparatus of claim 1 in which the top means includes an aperture through which the pole extends and the base means further includes a vertical wall extending between the aperture and the upwardly extending wall about the cup.

16. The apparatus of claim 1 in which the top means includes a first aperture aligned with the cup means for receiving the pole, and a second aperture for filling and draining the base.

17. The apparatus of claim 16 in which the aperture means includes a third aperture for venting the base means.

* * * * *